US006450066B1

(12) United States Patent
Hu

(10) Patent No.: US 6,450,066 B1
(45) Date of Patent: Sep. 17, 2002

(54) HEAD OF A WRENCH HANDLE

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 0 days.

(21) Appl. No.: 10/034,760

(22) Filed: Dec. 27, 2001

(30) Foreign Application Priority Data

Oct. 19, 2001 (TW) ..... 90218054 U

(51) Int. Cl.[7] ..... B25B 13/46
(52) U.S. Cl. ..... 81/60; 81/61; 81/63.1
(58) Field of Search ..... 81/60, 61, 62, 81/63, 63.1, 63.2, 58

(56) References Cited

U.S. PATENT DOCUMENTS

| | | | |
|---|---|---|---|
| 15,482 | A | 8/1856 | Gilman |
| 810,599 | A | 1/1906 | Ansorge |
| 841,686 | A | 1/1907 | Hatfield |
| 893,097 | A | 7/1908 | Reams |
| 915,446 | A | 3/1909 | Kearnes |
| 1,033,358 | A | 7/1912 | Turner |
| 1,194,471 | A | 8/1916 | Boosinger |
| 1,261,092 | A | 4/1918 | Allen |
| 1,382,492 | A | 6/1921 | Evans |
| 1,426,127 | A | 8/1922 | Tuttle |
| 1,614,039 | A | 1/1927 | Mandl |
| 1,957,462 | A | 5/1934 | Kress |
| 2,317,461 | A | 4/1943 | Jackson |
| 2,542,241 | A | 2/1951 | Fors |
| 2,657,604 | A | 11/1953 | Rueb |
| 2,701,977 | A | 2/1955 | Stone |
| 2,764,048 | A | 9/1956 | Thompson |
| 2,769,360 | A | 11/1956 | Cottrell et al. |
| 2,800,821 | A | 7/1957 | Fruscella |
| 2,891,434 | A | 6/1959 | Lozensky |
| 2,957,377 | A | 10/1960 | Hare |
| 3,019,682 | A | 2/1962 | Hare |
| 3,250,157 | A | 5/1966 | Badger |
| 3,337,014 | A | 8/1967 | Sandrick |
| 3,393,587 | A | 7/1968 | Jolliff et al. |
| 3,393,780 | A | 7/1968 | Kilness |
| 3,436,992 | A | 4/1969 | Over et al. |
| 3,577,816 | A | 5/1971 | Alexander et al. |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—James G. Smith
*Assistant Examiner*—Hadi Shakeri
(74) *Attorney, Agent, or Firm*—Alan Kamrath; Rider, Bennett, Egan & Arundel, LLP

(57) ABSTRACT

A head of a wrench comprises a hole having a center and a radius. The head further includes a compartment communicated with the hole. A wall defining the compartment has a center of curvature and a radius of curvature. A ratio between the radius of curvature of the wall and the radius of the hole is equal to or greater than 0.5, but less than 1. A distance between the center of the hole and the center of curvature of the wall is selected to form a deeper compartment to thereby improve the torque-bearing capacity.

3 Claims, 16 Drawing Sheets

U.S. PATENT DOCUMENTS 3,713,356 A 1/1973 Knudsen
3,742,788 A 7/1973 Priest
3,838,614 A 10/1974 O'Donnell
3,908,487 A 9/1975 Plaw
4,070,932 A 1/1978 Jeannotte
4,111,077 A 9/1978 Cummings et al.
4,128,025 A 12/1978 Main et al.
4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Diebert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,807,500 A * 2/1989 Main ..... 81/63.1
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella
5,144,869 A 9/1992 Chow
5,157,994 A 10/1992 Krivec
5,178,047 A 1/1993 Arnold et al.
5,199,330 A 4/1993 Arnold et al.
5,199,335 A 4/1993 Arnold et al.
5,230,262 A * 7/1993 Ahlund et al. ..... 81/63.2
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,495,783 A * 3/1996 Slusar et al. ..... 81/63.2
5,499,560 A 3/1996 Aeschiliman
5,501,124 A 3/1996 Ashby
5,509,333 A 4/1996 Rion
5,533,427 A 7/1996 Chow
3,265,171 A 8/1996 Kilness
5,557,994 A 9/1996 Nakayama
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
5,829,326 A 11/1998 Richner
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,152,826 A 11/2000 Profeta et al.
6,161,454 A 12/2000 Chaconas
6,164,167 A 12/2000 Chen
6,205,889 B1 * 3/2001 Hsieh ..... 81/60
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,922 B1 * 9/2001 Hu ..... 81/63.2
6,282,991 B1 9/2001 Hu
6,282,992 B1 9/2001 Hu
6,301,998 B1 10/2001 Hu
6,148,695 A1 * 11/2001 Hu ..... 81/60

* cited by examiner

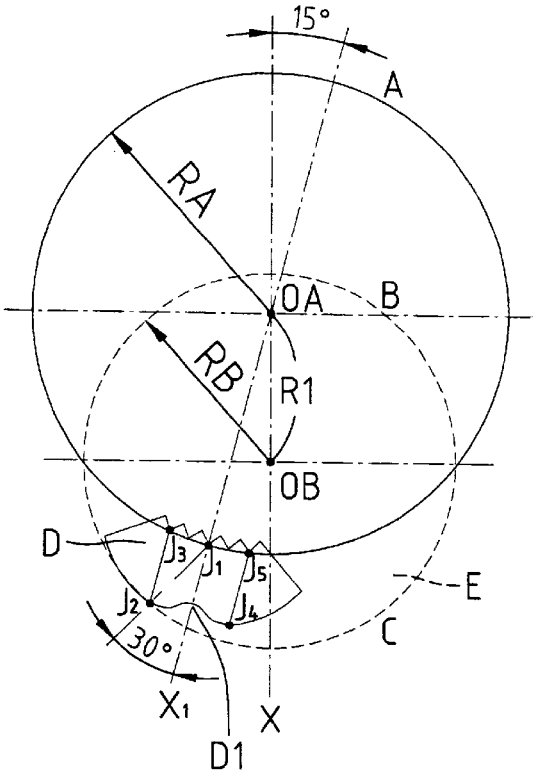
Fig. 5A
Fig. 5B
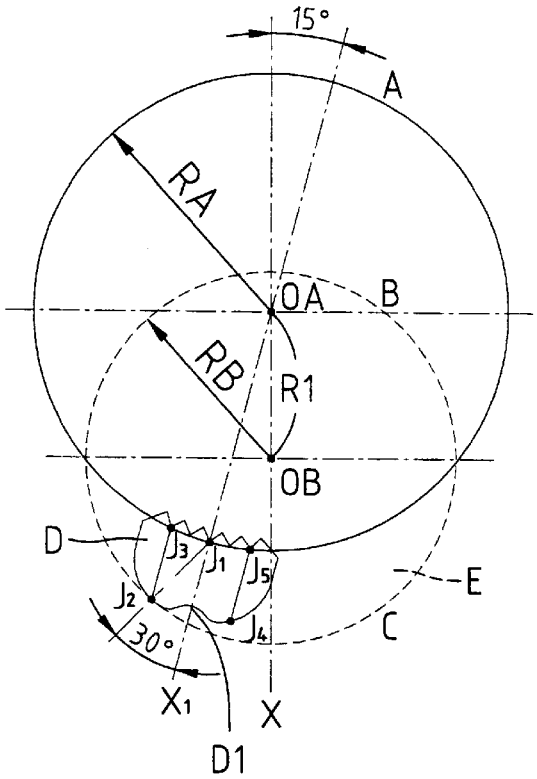
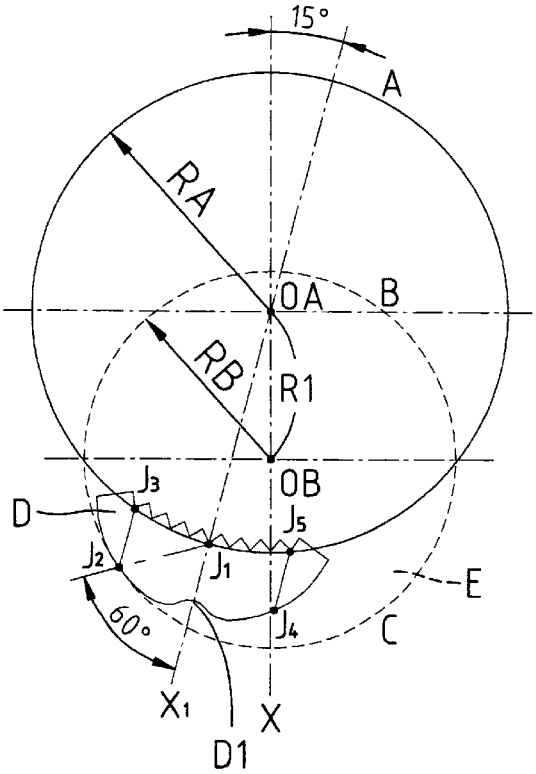
Fig. 5C

HEAD OF A WRENCH HANDLE

BACKGROUND OF THE INVENTION

1. Field of the Invention

The present invention relates to a head of a wrench handle with an improved torque-bearing capacity without increasing the manufacturing cost of the wrench.

2. Description of the Related Art

FIG. 1 of the drawings illustrates a handle head 100 of a conventional spanner type ratchet wrench. A gear 104 is rotatably mounted in a hole 100*a* in the head 100 and includes a polygonal inner periphery 101 for driving a fastener. The head 100 further includes a compartment 102 communicated with the hole 100*a* of the head 100. A pawl 103 is mounted in the compartment 102 and engaged with the gear 104. During ratcheting operation, the pawl 103 bears against a wall defining the compartment 102 at 105, which corresponds the third teeth counting from the leftmost tooth of the pawl 103 in FIG. 1. As can be seen from FIG. 1, the right portion of the pawl 103 is not supported such that when the force imparted to the pawl 103 reaches a critical value, no reactive force is obtained, and the pawl 103 will be disengaged from the gear 104 and move like a seesaw. The first three teeth will be damaged. This is owing to the fact that the compartment 103 is too shallow such that the pawl 103 merely engages with the gear 104 by only three effective teeth during the ratcheting operation. As a result, the torque-bearing capacity of the pawl 103 is poor. Enlargement of the head 100 would improve the torque-bearing capacity, yet the enlargement would contradict the benefit of the use of the spanner type ratchet type in a limited space.

FIG. 2 illustrates a pawl 106 having two centers E and F of curvatures. Namely, the pawl 106 includes a toothed side having a first teeth section 106*a* with a center E of curvature and a second teeth section 106*b* with a center F of curvature located at a position other than the center E of curvature. This allows more teeth of the pawl 106 in the compartment 108 to engage with the teeth 107*a* of the drive gear 107 of the wrench. Thus, during ratcheting, the second teeth portion 106*b* would not engage with the drive gear 107 when the first teeth portion 106*a* engages with the drive gear 107 and vice versa. This allows a stable, balanced operation of the pawl 106 during ratcheting, and the torque-bearing capacity was improved by 30%. Such a pawl has been disclosed in Applicant's U.S. patent application Ser. No. 09/523,625 filed on Mar. 13, 2000.

FIG. 3 illustrates a handle head of another wrench. The head 109 comprises a hole 109*c* for rotatably receiving a drive gear 109*d*. The head 109 further includes a compartment 109*a* communicated with the hole 109*c*, and a pawl 110 is slidably received in the compartment 109*a*. A cavity 109*e* is defined in a wall defining the compartment 109*a*, and a rigid pin 109*b* is fixed in the cavity 109*e*. The pawl 110 includes a toothed first side and a second recessed side 110*c* having two inclined faces 110*e*. The pawl 110 further includes two ends 110*b*. Thus, during ratcheting, the pawl 110 is supported at one of the ends 110*b* that bears against a side of the wall defining the compartment 109*a* and at one of the inclined faces 110*b* that bears against the rigid pin 109*b*. Almost all of the teeth of the pawl 110 are engaged with the drive gear 109*d*. Undesired disengagement of the pawl 110 from the drive gear 109*d* is prevented, and the torque-bearing capacity is improved. But the manufacturing cost is increased. Such a wrench has been disclosed in Applicant's U.S. patent application Ser. No. 09/916,796 filed on Jul. 27, 2001.

SUMMARY OF THE INVENTION

An object of the present invention is to provide a head of a wrench handle with an improved torque-bearing capacity without increasing the manufacturing cost of the wrench.

In accordance with one aspect of the invention, a head of a wrench comprises a hole having a center and a radius. The head further includes a compartment communicated with the hole. A wall defining the compartment has a center of curvature and a radius of curvature. A ratio between the radius (RB) of curvature of the wall and the radius (RA) of the hole and is defined as follows:

$$(0.5 \leqq RB/RA < 1)$$

and

A distance (R1) between the center of the hole and the center of curvature of the wall is defined as follows:

$$R1 > RA - 0.328 * RB$$

The present invention also provides a way to figure out a pawl for cooperating with the compartment thus formed.

Other objects, advantages, and novel features of the invention will become more apparent from the following detailed description when taken in conjunction with the accompanying drawings.

BRIEF DESCRIPTION OF THE DRAWINGS

FIG. 5A is a top view similar to FIG. 4A, illustrating formation of the head of the handle and a modified embodiment of the pawl of the wrench in accordance with the present invention.

FIG. 5B is a top view illustrating an embodiment modified from the embodiment of FIG. 5A.

FIG. 5C is a top view similar to FIG. 5A, illustrating formation of the head of the handle and a larger pawl of the wrench in accordance with the present invention.

DETAILED DESCRIPTION OF THE PREFERRED EMBODIMENTS

Figure 1:
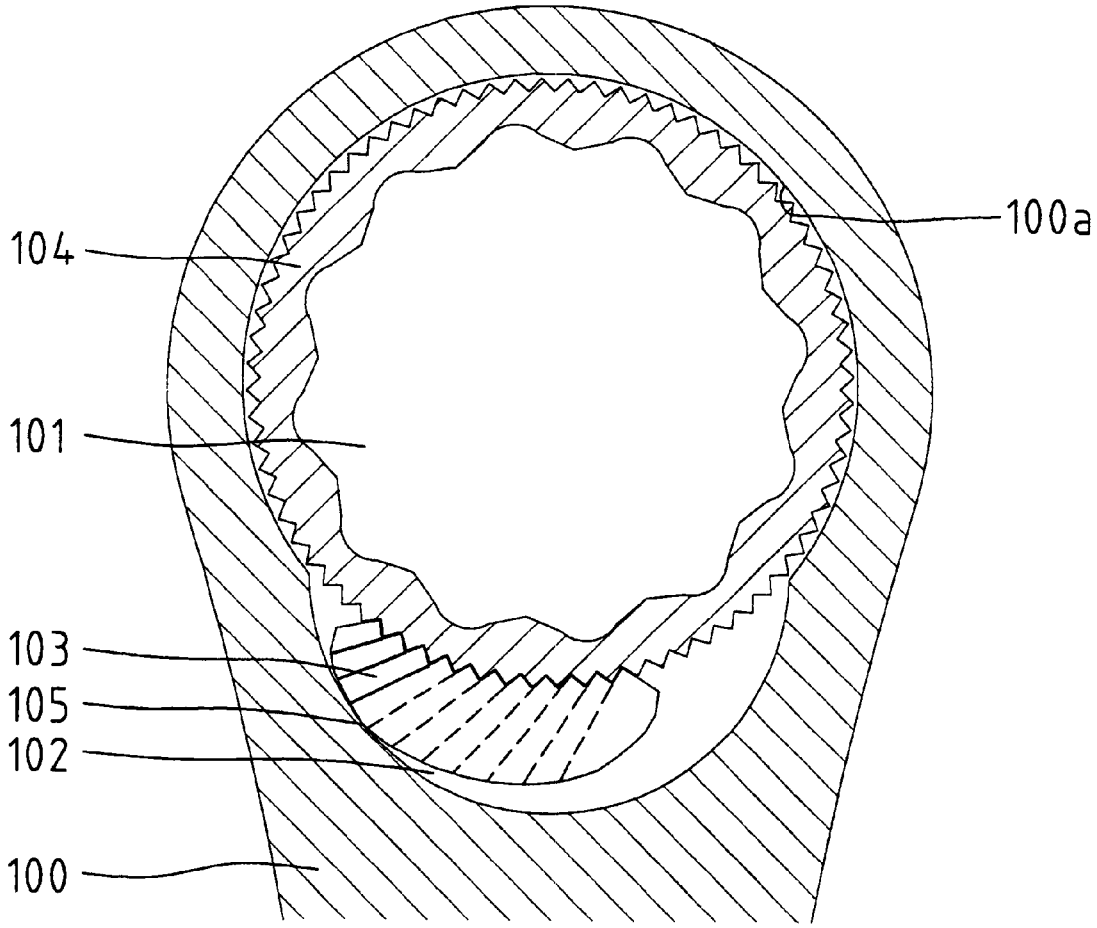
Fig. 1 PRIOR ART
FIG. 1 is a sectional view of a handle head of a conventional spanner type ratchet wrench.
Figure 2:
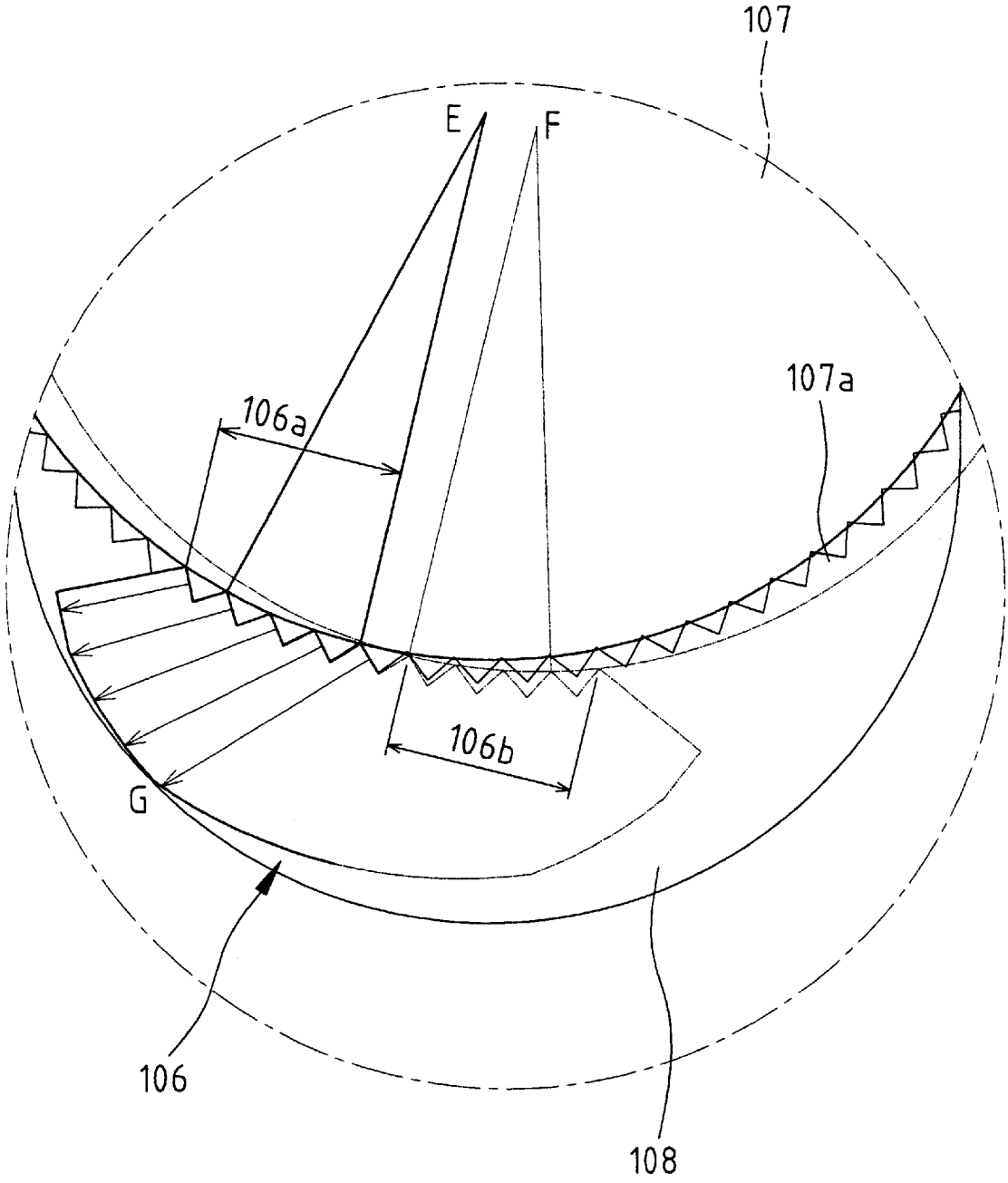
Fig. 2 PRIOR ART
FIG. 2 is a schematic view of a portion of a handle head of another conventional wrench.
Figure 3:
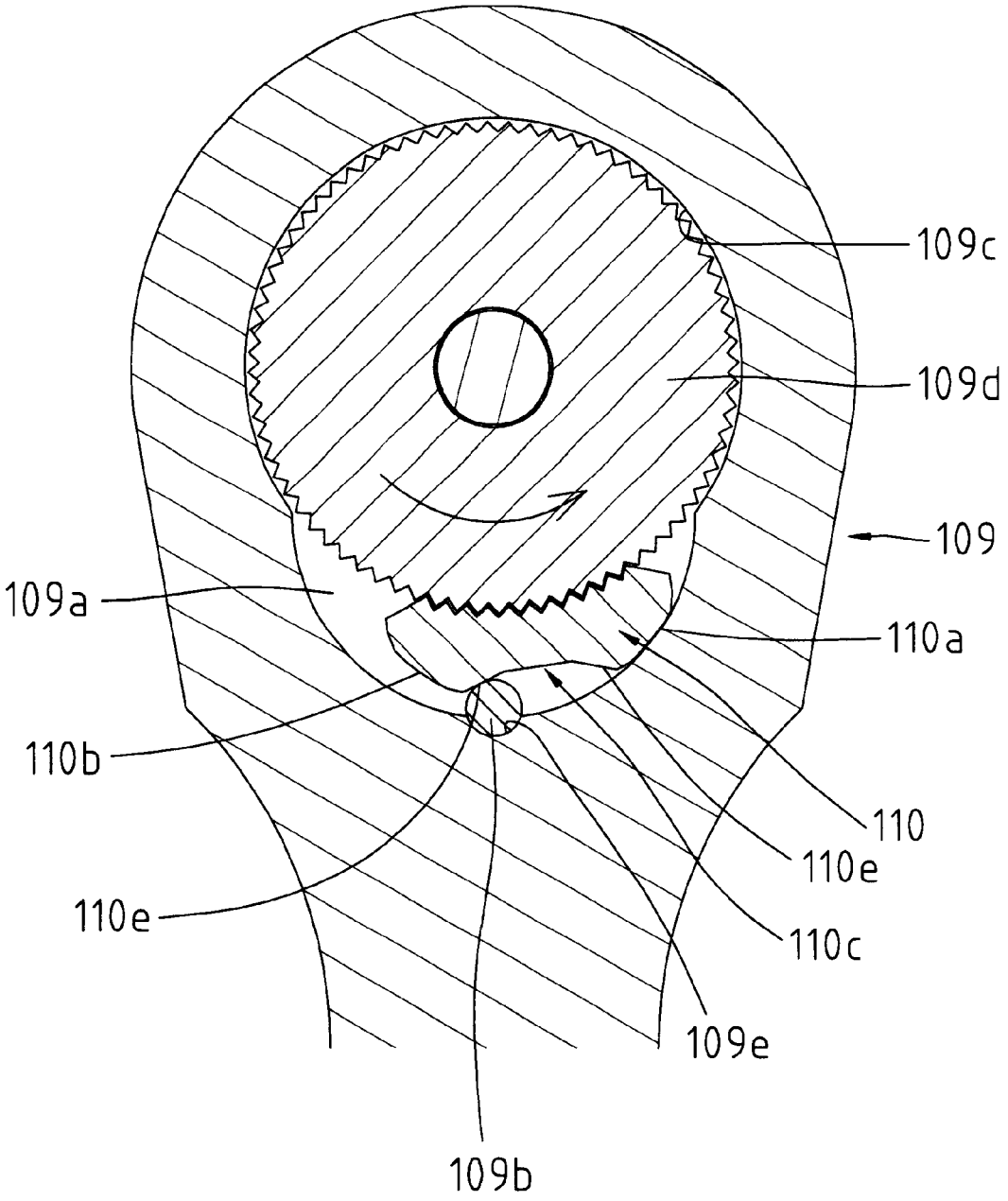
Fig. 3 PRIOR ART
FIG. 3 is a sectional view of a handle head of a further conventional wrench.
Figure 4A:
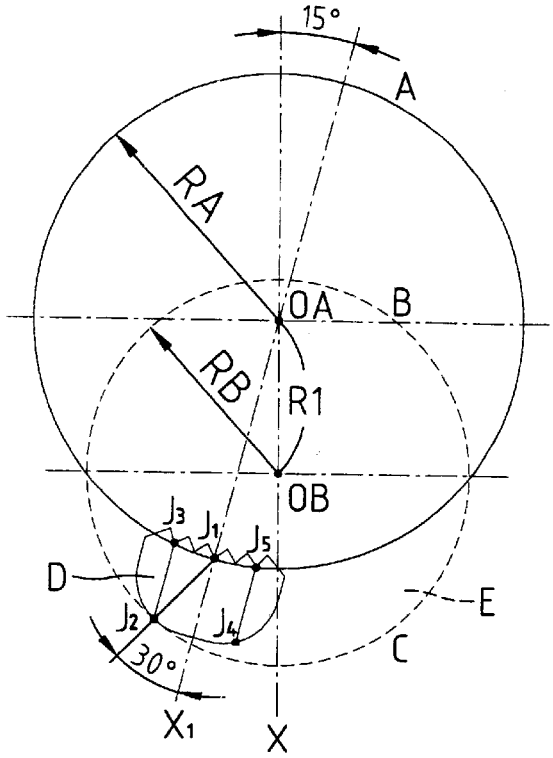
FIG. 4A is a top view illustrating formation of a head of a handle and a pawl of a wrench in accordance with the present invention.

In FIG. 4A, the point OA denotes the center of a hole A defined in a head of a handle of a wrench in accordance with the present invention. A longitudinal axis X of the handle passes the center OA of the hole A of the head. When deciding the location of the compartment in the head for receiving a pawl, a point OB on the longitudinal axis X is selected and a circle B having a center OB and a radius RB is formed. The radius RB of the circle B is smaller than a radius RA of the circle A. In particular, the ratio of RB/RA is equal to or greater than 0.5, but less than 1 ($0.5 \leqq RB/RA < 1$). In addition, the distance R1 between the centers OA and OB is greater than RA−0.328*RB (R1>RA−0.328*RB). A portion E of the circle B outside the circle A forms the compartment of the head of the handle in accordance with the present invention. The center OB is the center of curvature of a wall (see arc C) defining the compartment E.

In formation of the compartment in the handle head having a hole of a radius OA, a cutter (not shown) having a radius RB is placed in the hole (i.e., circle A) and then moved toward the handle along the longitudinal axis X of the handle. A cutter shaft (not shown) of the cutter reaches an arc C of the circle B, and a compartment E for receiving a pawl is thus formed. The radius RB of curvature of the compartment E (i.e., the radius of circle B) is equal to or greater than a half of the radius RA so as to provide a deeper compartment for improving the torque-bearing capacity. The travel of the cutter is the distance R1 between the centers OA and OB that is selected to be greater than 0.328*RB. This is because the ratio between the diameter of the cutter shaft and the diameter of a cutter base of the cutter is about 0.328. The compartment E thus formed in the head of the handle is deeper than that of the conventional handle. The torque-bearing capacity is thus improved. Thus, the present invention provides a head of a wrench handle with an improved torque-bearing capacity without increasing the manufacturing cost of the wrench.

Formation of a pawl corresponding to the compartment E of the head of the handle will now be described. Still referring to FIG. 4A, an axis X1 passing the center OA and being at an angle of 3°–15° is selected. In this embodiment, the axis X1 is at 15° with the longitudinal axis X. The axis X1 intersects the circumference of the circle A at $J_1$ that faces the arc C defining the compartment E. Next, a line $J_1$ $J_2$ passing $J_1$ is selected. The line $J_1$ $J_2$ is at an angle of 30°–60° with the axis X1 and intersects the arc C at $J_2$. In this embodiment, the line $J_1$ $J_2$ is at 30° with the axis X1. A line $J_2$ $J_3$ passing $J_2$ and parallel to axis X1 is selected and intersects the circle A at $J_3$. A point $J_4$ symmetric to point $J_2$ with respect to the axis X1 and a point $J_3$ symmetric to point $J_3$ with respect to the axis X1 are located. The points $J_2$ and $J_4$ form the bearing point of the pawl D thus formed. Namely, the pawl D bears against a wall defining the compartment E of the head of the handle at point $J_2$ when the wrench is driven in a direction, and the pawl D bears against the wall defining the compartment E of the head of the handle at point $J_4$ when the wrench is driven in a reverse direction. The area between points $J_3$ and $J_5$ is the engaging area of the pawl D thus formed. Namely, the pawl D engages with the drive gear rotatably received in the hole (i.e., circle A) in the head of the handle at the engaging area between points $J_3$ and $J_5$. The teeth located in the engaging area are completely engaged with the drive gear. Thus, the torque-bearing capacity of the pawl D is improved.

Figure 4B:
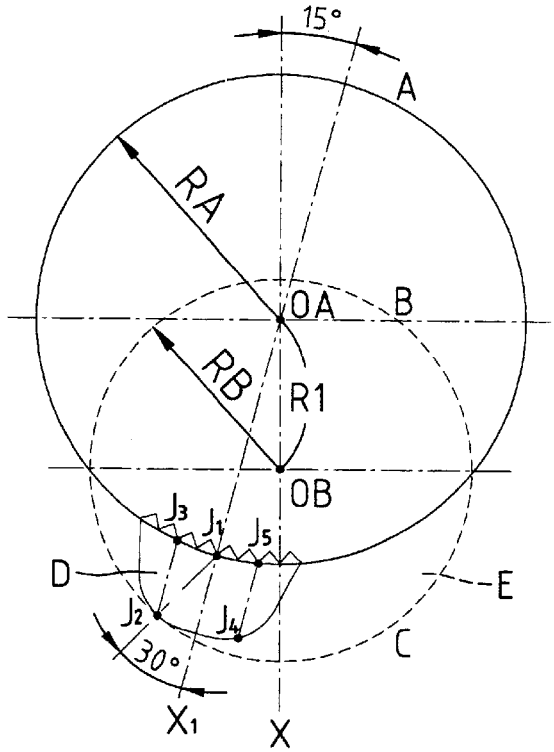
FIG. 4B is a top view illustrating an embodiment modified from the embodiment of FIG. 4A.
Figure 4C:
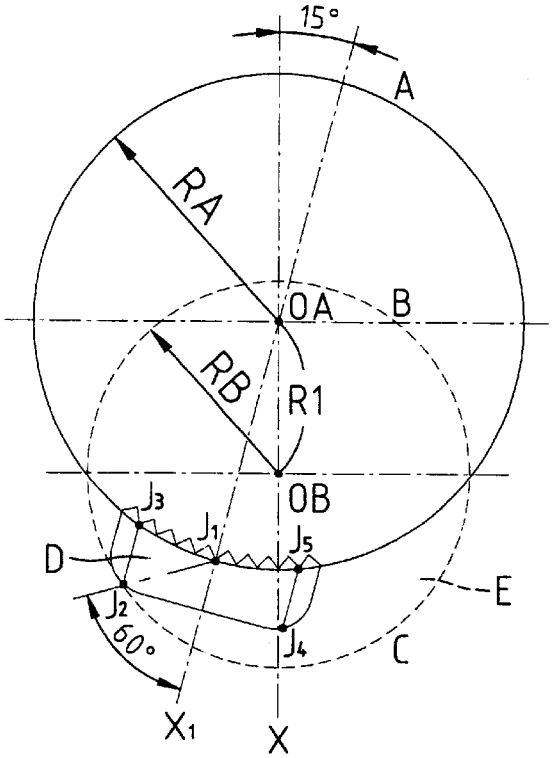
FIG. 4C is a top view similar to FIG. 4A, illustrating formation of a head of a handle and a larger pawl of a wrench in accordance with the present invention.

FIG. 4B illustrates an embodiment modified from FIG. 4A, wherein the pawl D may have more teeth arranged on both sides of the engaging area. FIG. 4C illustrates a modified embodiment for forming the pawl D, wherein the line $J_1$ $J_2$ is at 60° with the axis X1.

FIG. 5A illustrates an embodiment almost identical to FIG. 4A, except that the side of the pawl D facing away from the drive gear includes a recessed area D1 between the two bearing points $J_2$ and $J_4$. FIG. 5B illustrates an embodiment modified from FIG. 5A, wherein the pawl D may have more teeth arranged on both sides of the engaging area. FIG. 5C illustrates a modified embodiment for forming the pawl D, wherein the line $J_1$ $J_2$ is at 60° with the axis X1.

Figure 6A:
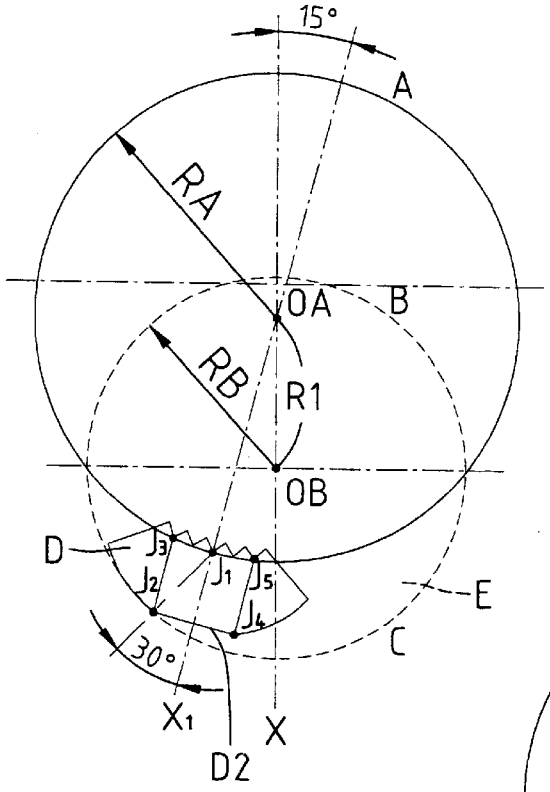
FIG. 6A is a top view similar to FIG. 4A, illustrating formation of the head of the handle and another modified embodiment of the pawl of the wrench in accordance with the present invention.
Figure 6B:
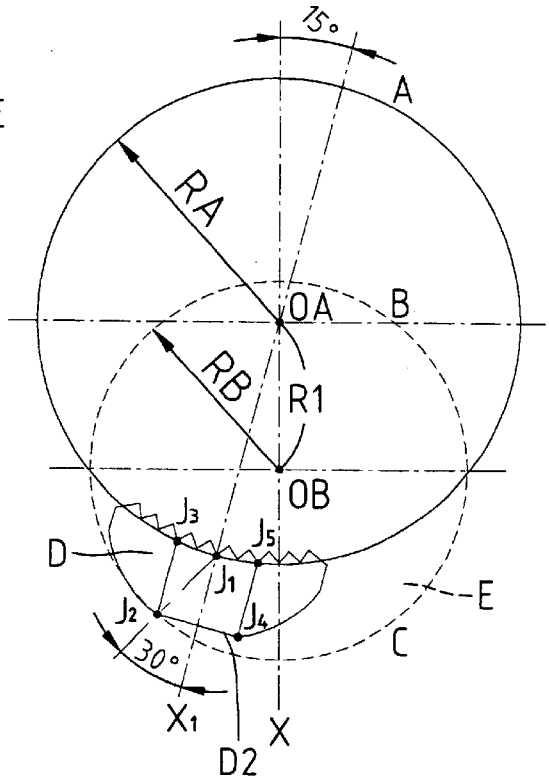
FIG. 6B is a top view illustrating an embodiment modified from the embodiment of FIG. 6A.
Figure 6C:
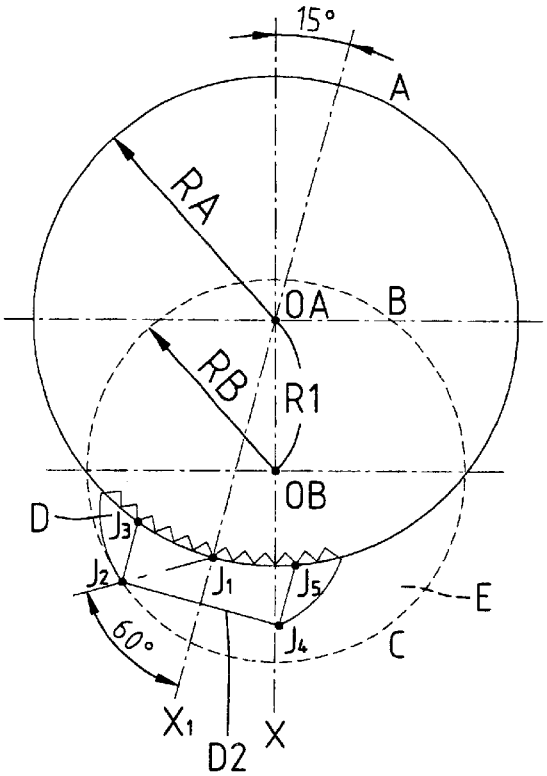
FIG. 6C is a top view similar to FIG. 6A, illustrating formation of the head of the handle and a larger pawl of the wrench in accordance with the present invention.

FIG. 6A illustrates an embodiment almost identical to FIG. 4A, except that the side of the pawl D facing away from the drive gear is rectilinear (see D2) between the two bearing points $J_2$ and $J_4$. FIG. 6B illustrates an embodiment modified from FIG. 6A, wherein the pawl D may have more teeth arranged on both sides of the engaging area. FIG. 6C illustrates a modified embodiment for forming the pawl D, wherein the line $J_1$ $J_2$ is at 60° with the axis X1.

Figure 7A:
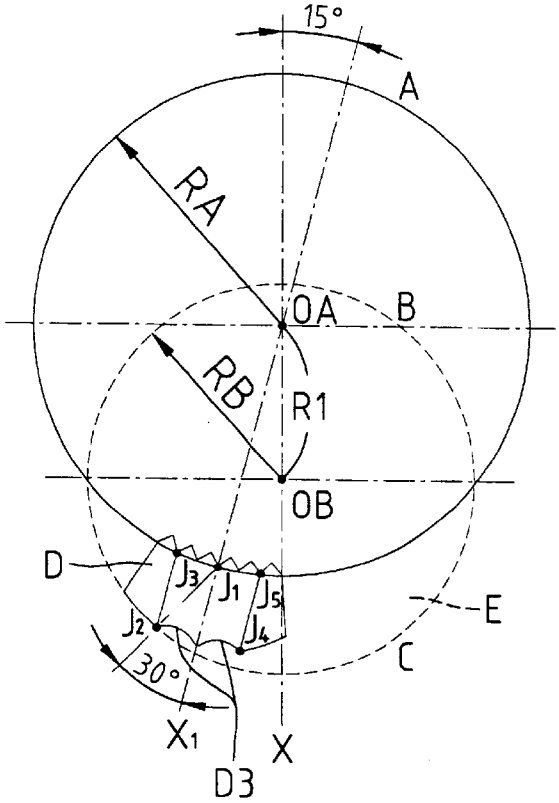
FIG. 7A is a top view similar to FIG. 4A, illustrating formation of the head of the handle and a modified embodiment of the pawl of the wrench in accordance with the present invention.
Figure 7B:
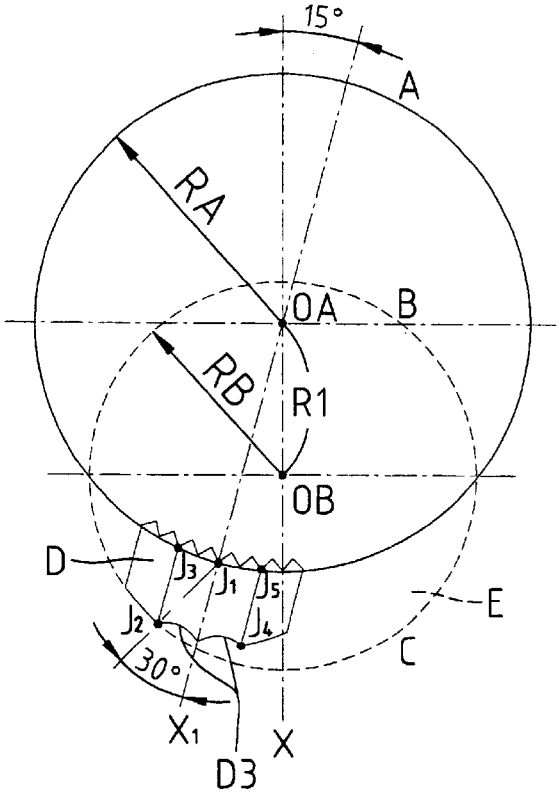
FIG. 7B is a top view illustrating an embodiment modified from the embodiment of FIG. 5A.
Figure 7C:
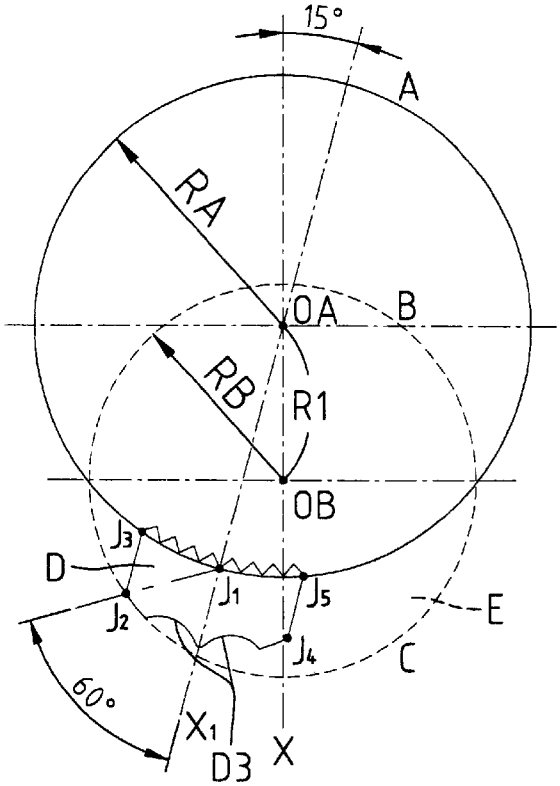
FIG. 7C is a top view similar to FIG. 7A, illustrating formation of the head of the handle and a larger pawl of the wrench in accordance with the present invention.

FIG. 7A illustrates an embodiment almost identical to FIG. 4A, except that the side of the pawl D facing away from the drive gear includes two recessed portions D3 between the two bearing points $J_2$ and $J_4$. FIG. 7B illustrates an embodiment modified from FIG. 7A, wherein the pawl D may have more teeth arranged on both sides of the engaging area. FIG. 7C illustrates a modified embodiment for forming the pawl D, wherein the line $J_1$ $J_2$ is at 60° with the axis X1.

Figure 8:
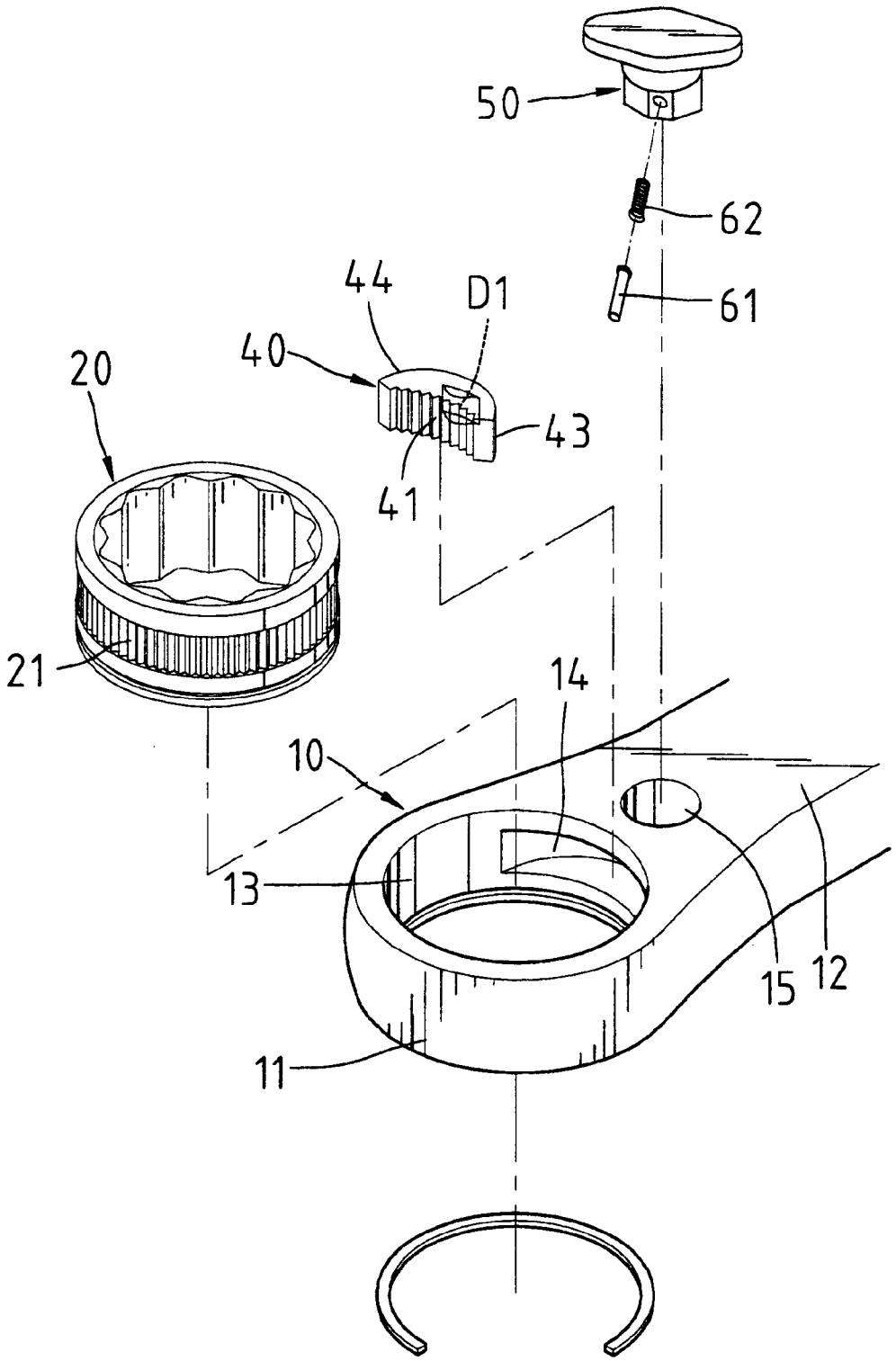
FIG. 8 is an exploded perspective view of a portion of a wrench having a structure shown in FIG. 5C.
Figure 9:
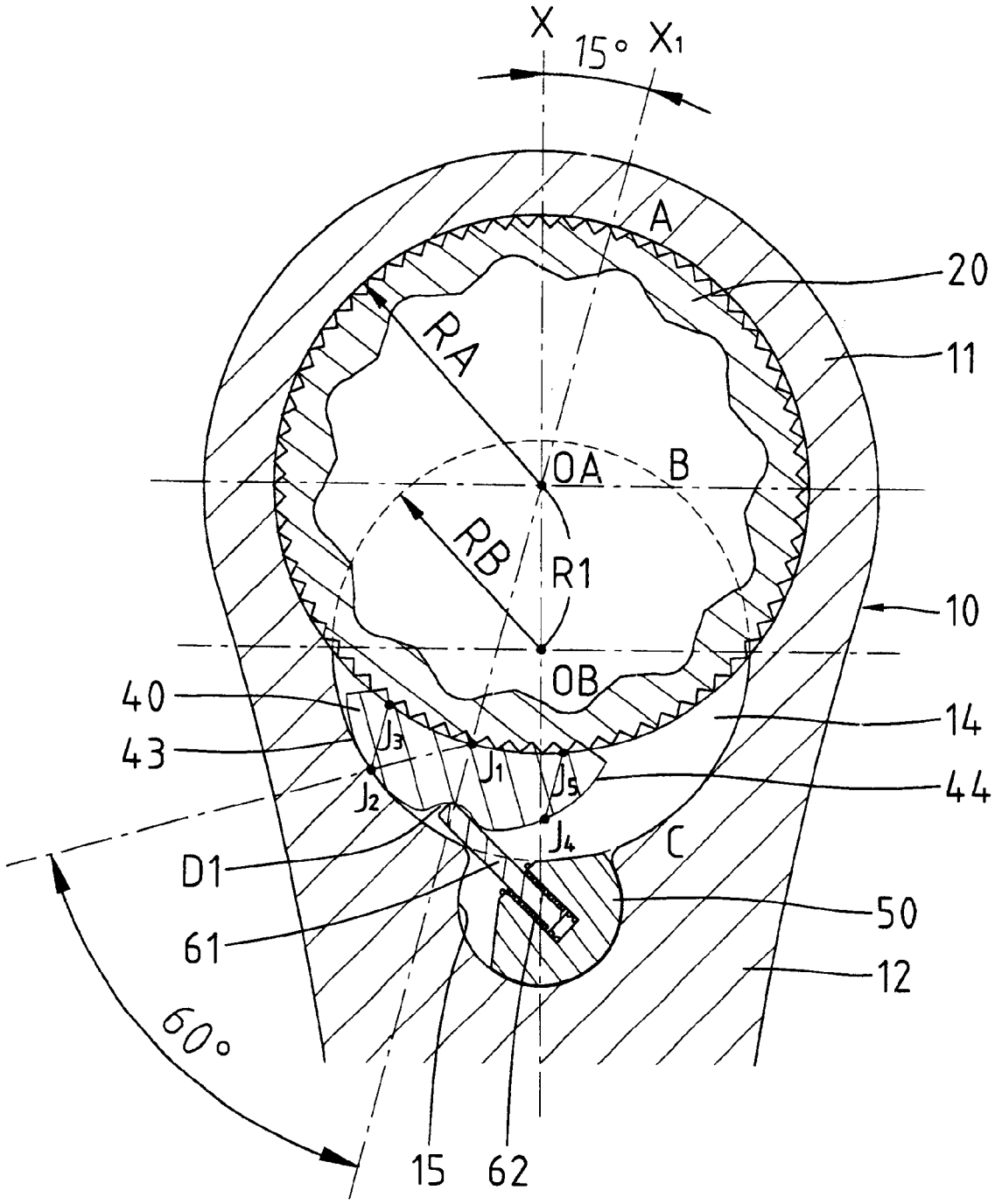
FIG. 9 is a sectional view of the portion of the wrench in FIG. 8.
Figure 10:
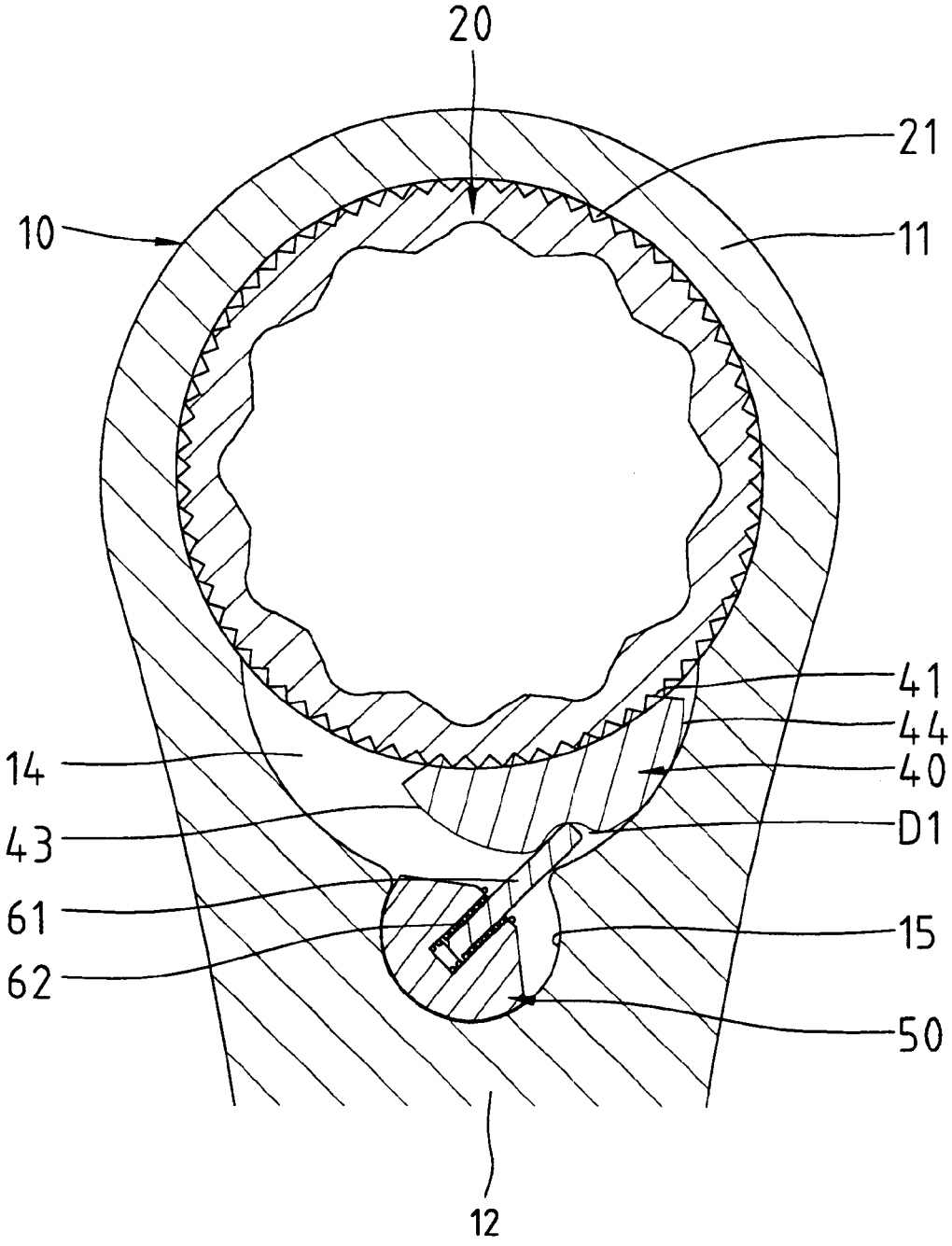
FIG. 10 is a sectional view similar to FIG. 9, wherein the pawl is in a position allowing ratcheting in a reverse direction.

FIGS. 8 and 9 illustrate a portion of a wrench having a structure shown in FIG. 5C. The wrench 10 includes a handle 12 and a head 11 having a hole 13 for rotatably receiving a drive gear 20. A compartment 14 is defined in the head 11 and communicated with the hole 13. A pawl 40 is slidably received in the compartment 14 and includes a toothed side 41 for engaging with teeth 21 on an outer periphery of the drive gear 20. The compartment 14 and the pawl 40 are constructed in accordance with the present invention, as mentioned above. The pawl 40 includes a second side facing away from the drive gear 20 as well as first and second ends 43 and 44. The handle 12 includes a transverse hole 15 for rotatably receiving a switch member 50. A pin 61 is biased by a spring 62 and includes an end received in a recessed area D1 in the second side of the pawl 40. The spring 62 is mounted in the switch member 50 for changing the position of the pin 61, thereby switching the pawl 40 between two positions respectively shown in FIG. 9 and FIG. 10. The torque-bearing capacity of the pawl 40 in accordance with the present invention is higher than that of conventional wrenches. This is owing to the advantageous designs of the compartment 14 and the pawl 40. FIG. 10 is a sectional view similar to FIG. 9, wherein the pawl is in a position allowing ratcheting in a reverse direction.

Figure 11:
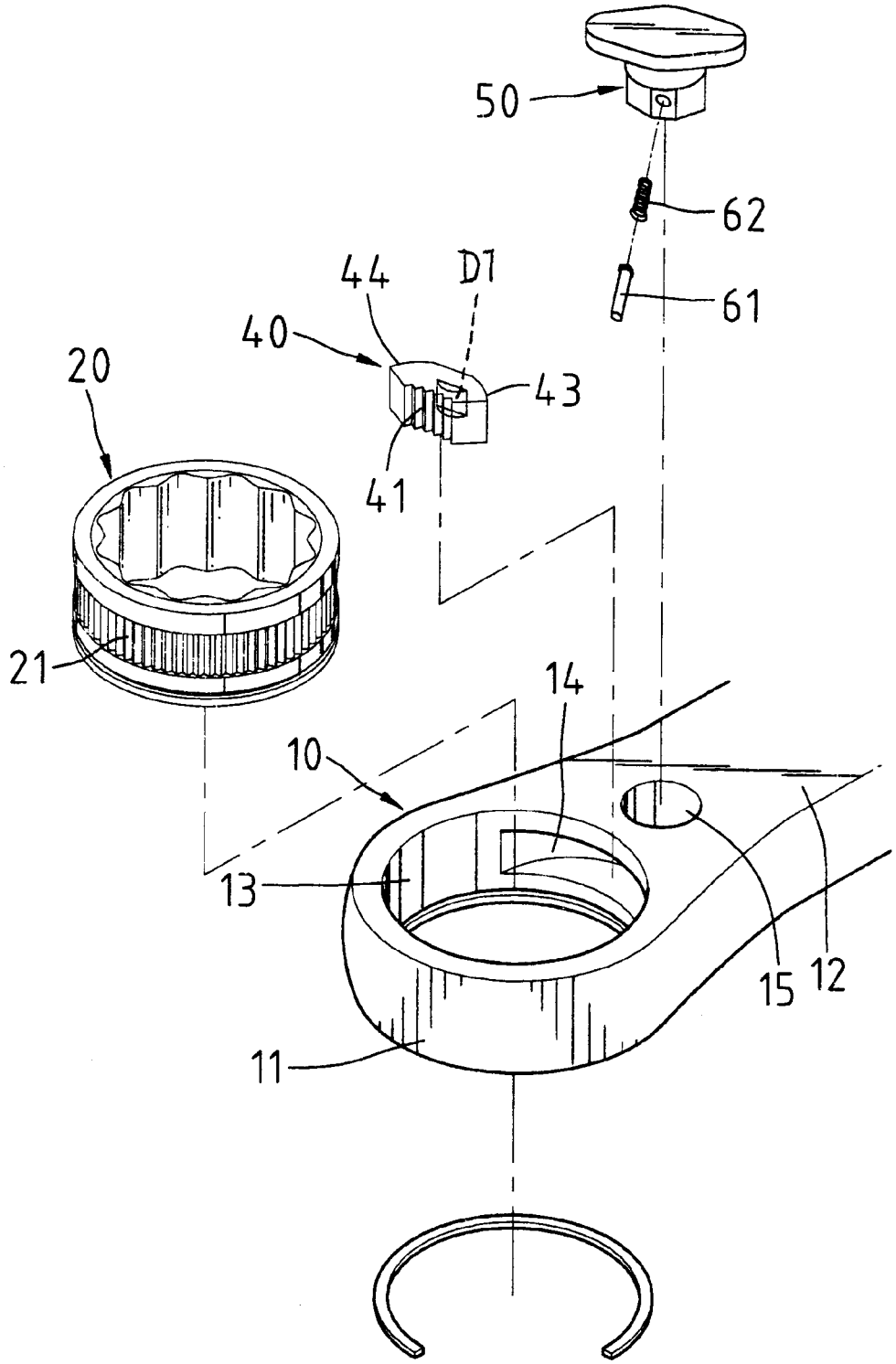
FIG. 11 is an exploded perspective view of a portion of a wrench having a structure shown in FIG. 5A.
Figure 12:
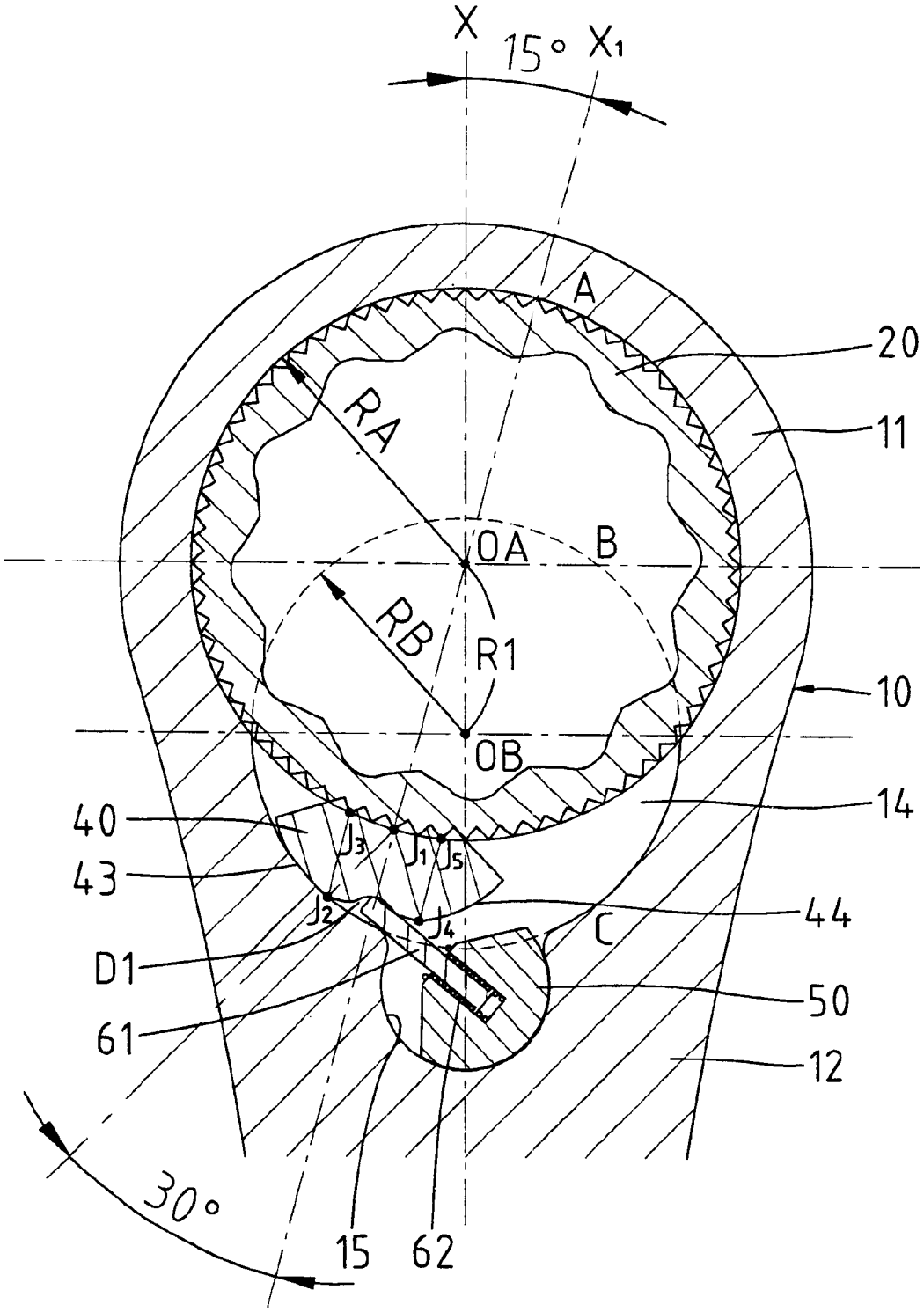
FIG. 12 is a sectional view of the portion of the wrench in FIG. 11.
Figure 13:
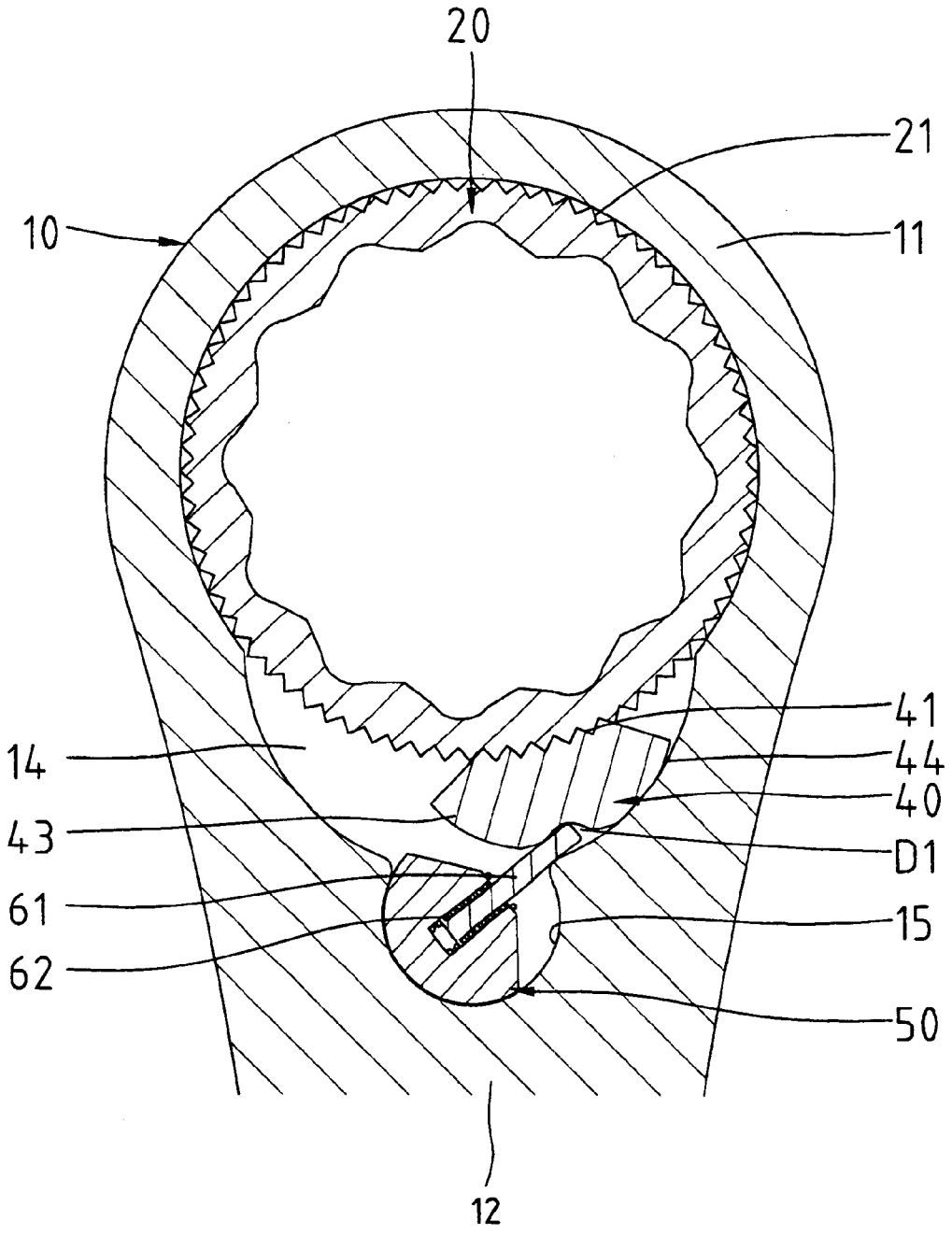
FIG. 13 is a sectional view similar to FIG. 12, wherein the pawl is in a position allowing ratcheting in a reverse direction.

FIGS. 11 through 13 illustrates a modified embodiment in accordance with the present invention that is identical to that illustrated in FIGS. 8 through 10, except that the compartment of the head 11 in FIGS. 11 through 13 is identical to that shown in FIG. 5A; namely, the line $J_1$ $J_2$ is at 60° with the axis X1 in the embodiment of FIGS. 11 through 13, while the line $J_1$ $J_2$ is at 60° with the axis X1 in the embodiment of FIGS. 8 through 10.

Figure 14:
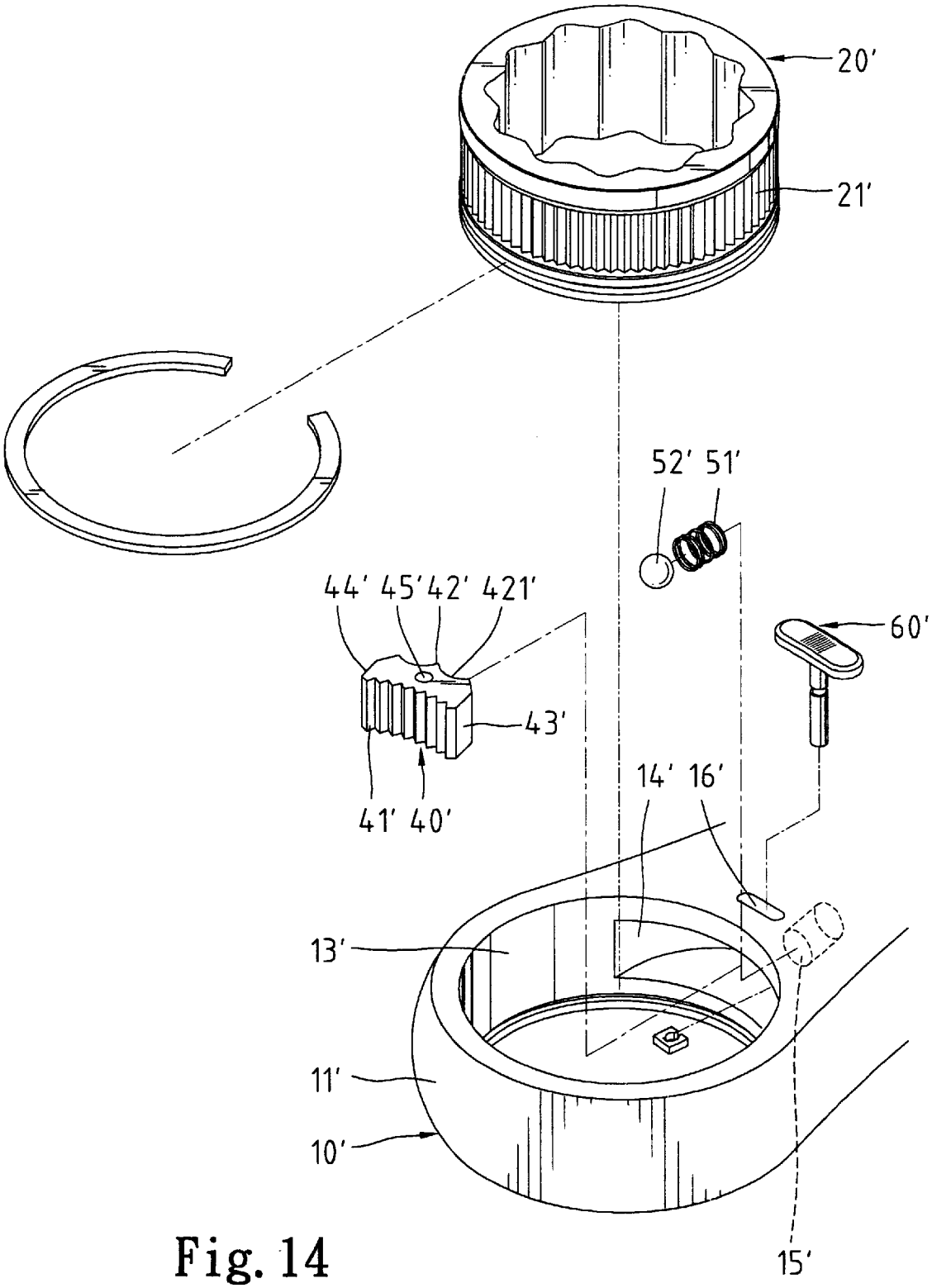
FIG. 14 is an exploded perspective view of a portion of a wrench having a structure shown in FIG. 7C.
Figure 15:
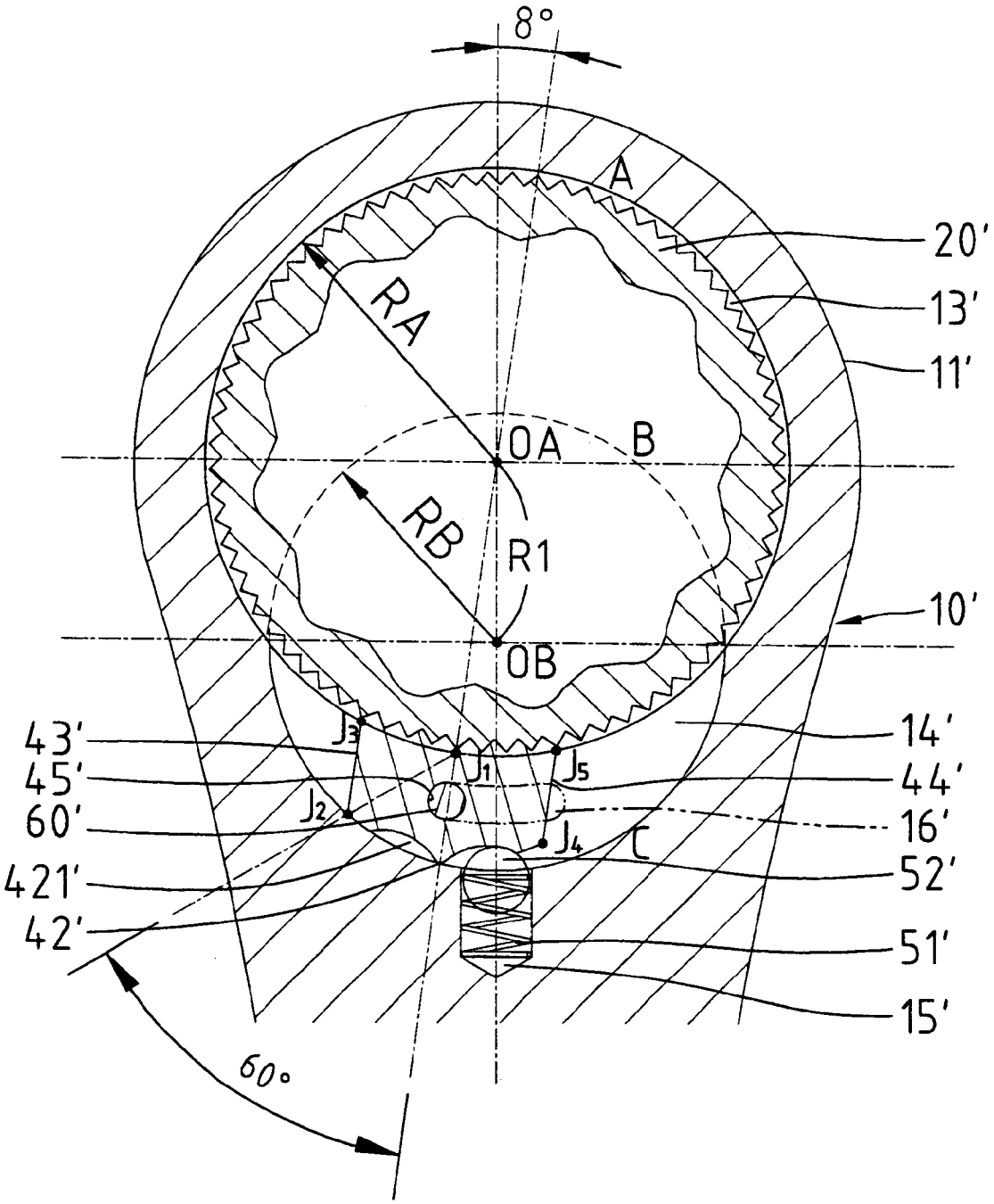
FIG. 15 is a sectional view of the portion of the wrench in FIG. 14.

FIGS. 14 and 15 illustrate a portion of a wrench having a structure shown in FIG. 7C. The wrench 10' includes a head 11' having a hole 13' for rotatably receiving a drive gear 20'. A compartment 14' is defined in the head 11' and communicated with the hole 13'. A pawl 40' is slidably received in the compartment 14' and includes a toothed side 41' for engaging with teeth 21' on an outer periphery of the drive gear 20'. The compartment 14' and the pawl 40' are constructed in accordance with the present invention, as mentioned above. The pawl 40' includes a second side facing away from the drive gear 20' as well as first and second ends 43' and 44'. The second side of the pawl 40' includes two recessed portions 421' spaced by a ridge 42'. The head 11' includes a transverse slot 16' through which a switch member 60' extends. A ball 52' is biased by a spring 51' and is partially received in one of the recessed portions 421' of the pawl 40'. Thus, the switch member 60' can be operated to switch the pawl 40' between two positions respectively shown in FIG. 15 and FIG. 16. The torque-bearing capacity of the pawl 40' in accordance with the present invention is higher than that of conventional wrenches. This is owing to the advantageous designs of the compartment 14' and the pawl 40'.

Figure 16:
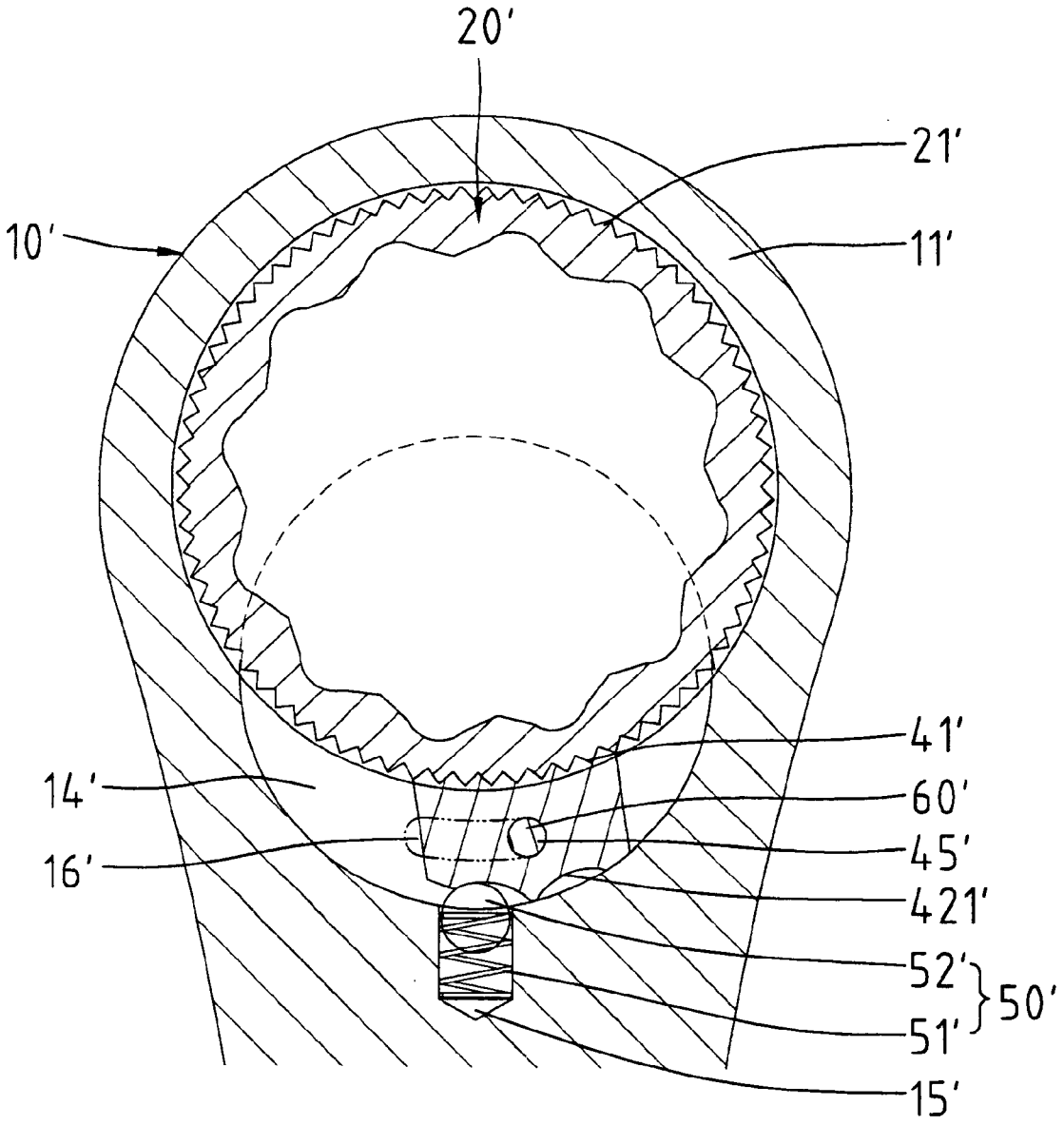
FIG. 16 is a sectional view similar to FIG. 15, wherein the pawl is in a position allowing ratcheting in a reverse direction.

FIG. 16 is a sectional view similar to FIG. 15, wherein the pawl 40' is in a position allowing ratcheting in a reverse direction.

Thus, the present invention provides a head of a wrench handle with an improved torque-bearing capacity without increasing the manufacturing cost of the wrench.

Although the invention has been explained in relation to its preferred embodiment, it is to be understood that many other possible modifications and variations can be made without departing from the scope of the invention as hereinafter claimed.

What is claimed is:

1. A head of a wrench comprising a hole (A) having a center (OA) and a radius (RA), the head further including a compartment (E) communicated with the hole (A), a wall (C) defining the compartment (E) having a center (OB) of curvature and a radius (RB) of curvature;

wherein a ratio between the radius (RB) of curvature of the wall (C) and the radius (RA) of the hole (A) is defined as follows:

$$(0.5 \leq RB/RA < 1)$$

and wherein a distance (R1) between the center (OA) of the hole and the center (OB) of curvature of the wall (C) is defined as follows:

$$R1 > RA - 0.328 * RB.$$

2. A combination of a head of a wrench and a pawl comprising:

a head including a hole (A) having a center (OA) and a radius (RA), a drive gear being rotatably received in the hole of the head, the head further including a compartment (E) communicated with the hole (A), a wall (C) defining the compartment (E) having a center (OB) of curvature and a radius (RB) of curvature; and a pawl (D) slidably received in the compartment (E) of the head, the pawl including a toothed first side facing the hole and a second side facing away from the hole, the second side of the pawl including two bearing points ($J_2$ and $J_4$) selectively bearing against the wall (C) defining the compartment during ratcheting operation of the pawl, the toothed first side of the pawl including an engaging area ($J_3$ $J_5$) completely engaged with the drive gear during the ratcheting operation;

wherein a ratio between the radius (RB) of curvature of the wall (C) and the radius (RA) of the hole (A) is defined as follows:

$$(0.5 \leq RB/RA < 1)$$

wherein a distance (R1) between the center (OA) of the hole and the center (OB) of curvature of the wall (C) is defined as follows:

$$R1 > RA - 0.328 * RB$$

wherein the bearing points ($J_2$ and $J_4$) on the second side of the pawl and the engaging area ($J_3J_5$) on the toothed first side of the pawl are located by the following steps:

selecting an axis (X1) that passes the center (OA) of the hole (A) and that is at an angle of 3°–15° with a longitudinal axis (X) of the wrench, the axis (X1) intersecting the circle (A) at a first point ($J_1$);

selecting a first line ($J_1$ $J_2$) that passes the first point ($J_1$) and that is at an angle of 30°–60° with the axis (X1), the first line ($J_1$ $J_2$) intersecting the wall (C) defining the compartment (E) at a second point ($J_2$), a third point ($J_4$) symmetric to the second point ($J_2$) with respect to the axis (X1) being located, the second point ($J_2$) and the third point ($J_4$) forming the bearing points on the second side of the pawl (D); and selecting a second line ($J_2$ $J_3$) that passes the second point ($J_2$) and that is parallel to the axis (X1), the second line($J_2$ $J_3$) intersecting the circle (A) at a fourth point ($J_3$), a fifth point ($J_5$) symmetric to the fourth point ($J_3$) with respect to the axis (X1) being located, an area between the fourth point ($J_3$) and the fifth point ($J_5$) forming the engaging area on the toothed first side of the pawl (D).

3. The combination as claimed in claim 2, wherein the first toothed side of the pawl includes at least one tooth on each of both sides of the engaging area of the pawl.

* * * * *